US010150641B2

(12) United States Patent
Noso et al.

(10) Patent No.: US 10,150,641 B2
(45) Date of Patent: Dec. 11, 2018

(54) SHEET POST-PROCESSING DEVICE AND IMAGE FORMING APPARATUS

(71) Applicant: KYOCERA Document Solutions Inc., Osaka (JP)

(72) Inventors: Terumitsu Noso, Osaka (JP); Yasunori Ueno, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 21 days.

(21) Appl. No.: 15/153,243

(22) Filed: May 12, 2016

(65) Prior Publication Data

US 2016/0347572 A1 Dec. 1, 2016

(30) Foreign Application Priority Data

May 27, 2015 (JP) ..... 2015-107504

(51) Int. Cl.
*B65H 31/10* (2006.01)
*B65H 37/04* (2006.01)
(Continued)

(52) U.S. Cl.
CPC ..... *B65H 37/04* (2013.01); *B65H 31/02* (2013.01); *B65H 31/10* (2013.01); *B65H 31/3027* (2013.01); *B65H 31/3081* (2013.01); *B65H 31/36* (2013.01); *B65H 2220/09* (2013.01); *B65H 2301/4212* (2013.01); *B65H 2301/4213* (2013.01); *B65H 2404/144* (2013.01);
(Continued)

(58) Field of Classification Search
CPC ..... B65H 2301/4223; B65H 2301/163
See application file for complete search history.

(56) References Cited

U.S. PATENT DOCUMENTS 5,599,009 A 2/1997 Mandel et al.
5,603,492 A 2/1997 Mandel et al.
(Continued)

FOREIGN PATENT DOCUMENTS

JP H05-319679 A 12/1993
JP H09-124224 A 5/1997
JP 2002-087685 A 3/2002

OTHER PUBLICATIONS

An Office Action; "Notice of Reasons for Rejection," mailed by the Japanese Patent Office dated Jan. 9, 2018, which corresponds to Japanese Patent Application No. 2015-107504 and is related to U.S. Appl. No. 15/153,243.

*Primary Examiner* — Jennifer E Simmons
(74) *Attorney, Agent, or Firm* — Studebaker & Brackett PC

(57) ABSTRACT

A post-processing unit in an image forming apparatus includes a stapler, an exit tray, a height detector, and a shifting controller. The stapler staples a sheet sheaf. The exit tray is configured to be elevated and lowered and to receive the sheet sheaf stapled by the stapler. The height detector detects a height of the sheet sheaf on the exit tray. The shifting controller shifts the sheet sheaf to be ejected in a situation in which the stapler staples one location at a trailing end of the sheet sheaf in a conveyance direction of the sheet sheaf. The shifting controller shifts the sheet sheaf in a front-rear direction, which is a direction perpendicular to a vertical direction and to the conveyance direction of the sheet sheaf, so that the stapled location in the sheet sheaf on the exit tray matches a detection point of the height detector.

14 Claims, 12 Drawing Sheets

(51) Int. Cl.
*B65H 31/02* (2006.01)
*B65H 31/30* (2006.01)
*B65H 31/36* (2006.01)

(52) U.S. Cl.
CPC .... *B65H 2511/152* (2013.01); *B65H 2511/20* (2013.01); *B65H 2553/612* (2013.01); *B65H 2801/06* (2013.01)

(56) References Cited

U.S. PATENT DOCUMENTS

| | | | | |
|---|---|---|---|---|
| 5,609,333 | A * | 3/1997 | Mandel | B65H 39/11 270/58.09 |
| 5,815,764 | A | 9/1998 | Tomory | |
| 5,823,529 | A | 10/1998 | Mandel et al. | |
| 6,382,614 | B1 * | 5/2002 | Fukatsu | B42C 1/12 270/58.09 |
| 7,448,615 | B2 * | 11/2008 | Takamura | B42C 1/12 270/58.11 |

* cited by examiner

SHEET POST-PROCESSING DEVICE AND IMAGE FORMING APPARATUS

INCORPORATION BY REFERENCE

The present application claims priority under 35 U.S.C. § 119 to Japanese Patent Application No. 2015-107504, filed on May 27, 2015. The contents of this application are incorporated herein by reference in their entirety.

BACKGROUND

The present disclosure relates to a sheet post-processing device that staples a sheet sheaf and to an image forming apparatus.

It is generally known that paper sheets on which an image has been formed is ejected and stacked on an exit tray. It is also known that the exit tray is elevated and lowered according to the height of the stack of paper sheets.

In one example, a disclosed paper ejecting device detects the height of a stack of paper sheets on an exit tray using an arm that touches a top surface of the stack of paper sheets. The paper ejecting device detects a position of the top surface of the stack of paper sheets by detecting a position of a proximal end of the arm.

The paper ejecting device allows even stapled paper sheets to be stacked on the exit tray in an aligned manner.

SUMMARY

A sheet post-processing device according to an aspect of the present disclosure includes a stapler, an exit tray, a detector, and a shifting controller. The stapler staples a sheet sheaf. The exit tray is configured to be elevated and lowered and to receive the sheet sheaf stapled by the stapler. The detector detects a height of the sheet sheaf on the exit tray. The shifting controller shifts the sheet sheaf to be ejected in a situation in which the stapler staples one location in the sheet sheaf. The shifting controller shifts the sheet sheaf in a direction perpendicular to a vertical direction and to a conveyance direction of the sheet sheaf so that the stapled location in the sheet sheaf on the exit tray matches a detection point of the detector.

An image forming apparatus according to another aspect of the present disclosure includes the above-described sheet post-processing device and an image forming section. The image forming section is located upstream of the stapler in the conveyance direction of the sheet sheaf and forms an image on sheets of the sheet sheaf.

BRIEF DESCRIPTION OF THE DRAWINGS

FIG. 9A illustrates a state in which light shielding plates are located at a higher height than two sensors.

FIG. 9B illustrates a state in which the light shielding plates are located at the same height as the upper sensor.

FIG. 9C illustrates a state in which the light shielding plates are located at a height higher than the lower sensor and lower than the upper sensor.

FIG. 9D illustrates a state in which the light shielding plates are located at the same height as the lower sensor.

FIG. 9E illustrates a state in which the light shielding plates are located at a lower height than the two sensors.

FIG. 11A is a plan view of the post-processing unit.

FIG. 11B is a perspective view of the post-processing unit.

FIG. 12A is a plan view of the post-processing unit.

FIG. 12B is a perspective view of the post-processing unit.

DETAILED DESCRIPTION

Figure 1:
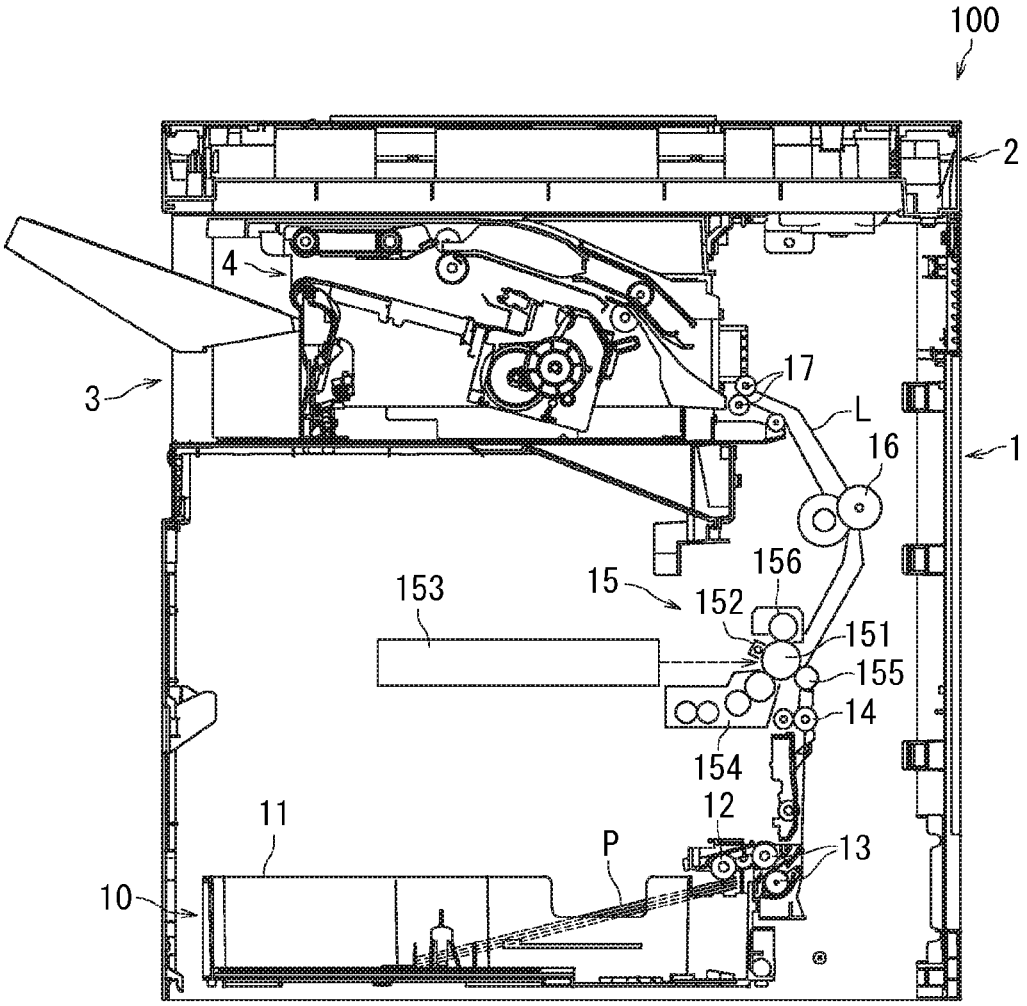
FIG. 1 is a side view illustrating configuration of an image forming apparatus according to an embodiment of the present disclosure.

The following describes an embodiment of the present disclosure with reference to the accompanying drawings (FIGS. 1 to 12B). Note that in the drawings, elements that are the same or substantially equivalent are labelled using the same reference signs and description thereof is not repeated.

First, an image forming apparatus 100 according to the present embodiment will be described with reference to FIG. 1. FIG. 1 is a diagram illustrating configuration of the image forming apparatus 100 according to the present embodiment. The image forming apparatus 100 herein is a multi-function peripheral (MFP). The image forming apparatus 100 has functions of a scanner, a copier, a printer, and a facsimile machine. The image forming apparatus 100 includes an image forming unit 1, an image reading unit 2, and a post-processing unit 3.

The image forming unit 1 forms an image on paper P. The image reading unit 2 reads an image formed on an original document. The post-processing unit 3 performs stapling processing on a sheaf Q of paper P (see FIG. 2). The post-processing unit 3 is equivalent to the "sheet post-processing device". Although the present embodiment is described for a configuration in which the stapling processing is performed on the sheaf Q of paper P, the above configuration is not a limitation. The stapling processing may be performed on sheets of another material such as a resin instead of paper P. In other words, the sheaf Q of paper P is an example of the "sheet sheaf".

The image forming unit 1 includes a sheet feed unit 10, a conveyance roller pair 13, a registration roller pair 14, an image forming section 15, a fixing section 16, an ejection roller pair 17, and a conveyance section L. The sheet feed unit 10 includes a sheet feed cassette 11 and a pickup roller 12. The pickup roller 12 picks up paper P from the sheet feed cassette 11 one sheet at a time. The paper P picked up by the pickup roller 12 is conveyed to the image forming section 15 by the conveyance roller pair 13 and the registration roller pair 14. The conveyance section L includes conveyance rollers and conveyance guides, and conveys the paper P.

The image forming section 15 forms an image on the paper P conveyed from the sheet feed cassette 11. The image forming section 15 includes a photosensitive drum 151, a charger 152, a light exposure section 153, a development section 154, a transfer roller 155, and a cleaning section 156. The photosensitive drum 151 is a circular tube-shaped rotary member and an electrostatic latent image is formed on a peripheral surface thereof. The charger 152 charges the photosensitive drum 151 to a specific electric potential. The light exposure section 153 irradiates the photosensitive drum 151 with laser light based on image data. As a result, an electrostatic latent image based on the image data is formed on the photosensitive drum 151. The image data is for example image data generated through the image reading unit 2 reading an original document or image data received from an external computer via a communication network not illustrated.

The development section 154 supplies toner to the electrostatic latent image formed on the photosensitive drum 151 to develop the electrostatic latent image. As a result, a toner image is formed on the photosensitive drum 151. The transfer roller 155 transfers the toner image from the photosensitive drum 151 to the paper P. The cleaning section 156 removes residual toner remaining on the photosensitive drum 151 after the transfer. The paper P on which the image has been formed by the image forming section 15 is conveyed to the fixing section 16.

The fixing section 16 thermally fixes the toner image to the paper P. The fixing section 16 includes a heating roller and a pressure roller. The heating roller has an internal heating element. The heating roller and the pressure roller are pressed against one another to form a fixing nip. The toner adhering to a surface of the paper P is heated and melted as the paper P passes through the fixing nip. As a result, the toner image is fixed to the paper P. The paper P to which the toner image has been fixed is ejected to the post-processing unit 3 by the ejection roller pair 17.

Figure 2:
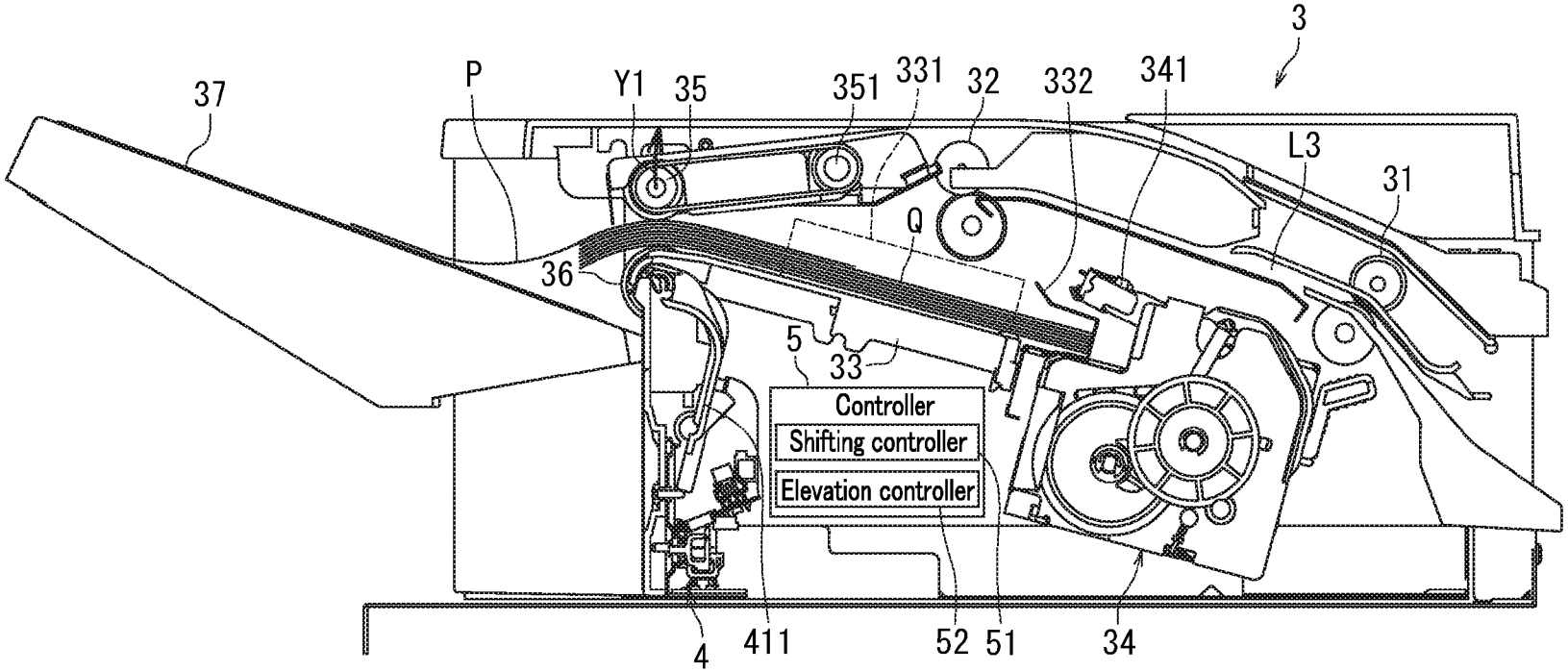
FIG. 2 is a side view illustrating configuration of a post-processing unit illustrated in FIG. 1.
Figure 3:
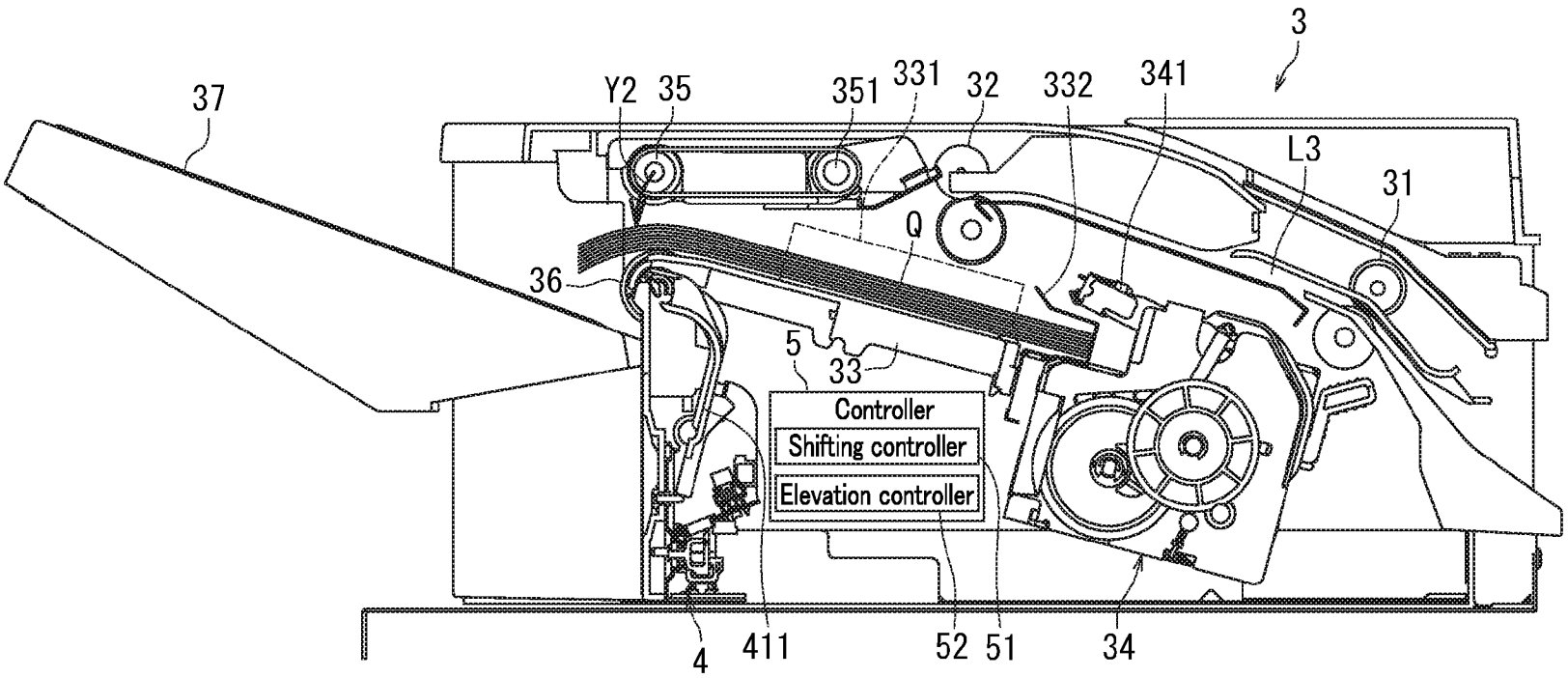
FIG. 3 is a side view illustrating the post-processing unit illustrated in FIG. 2 that is in a paper ejecting state.

The following describes configuration of the post-processing unit 3 with reference to FIGS. 2 and 3. FIG. 2 is a side view illustrating configuration of the post-processing unit 3. FIG. 3 is a side view illustrating the post-processing unit 3 in a paper ejecting state. The post-processing unit 3 includes a conveyance roller pair 31, an intermediate roller pair 32, a processing tray 33, a stapler 34, an ejection roller 35, an ejection roll 36, an exit tray 37, a conveyance section L3, and a controller 5. The post-processing unit 3 further includes a height detector 4.

The conveyance section L3 includes conveyance rollers and conveyance guides, and conveys the paper P. The conveyance roller pair 31 conveys the paper P ejected by the ejection roller pair 17 toward the intermediate roller pair 32. The intermediate roller pair 32 conveys the paper P toward the ejection roller 35. A sheaf Q of paper P is placed on the processing tray 33. The processing tray 33 includes a pair of sheet guides 331 and a sheet support plate 332. The sheet guides 331 are plate members stood at the near side and the far side on a plane of FIGS. 2 and 3 with a stack of sheets of paper P to be placed on the processing tray 33 therebetween. Note that in the present embodiment, the near side on the plane of FIGS. 2 and 3 is referred to as a front side, and the far side on the plane of FIGS. 2 and 3 is referred to as a rear side. A direction perpendicular to the plane of FIGS. 2 and 3 is referred to as a front-rear direction. The sheet guides 331 are movable in the front-rear direction. Furthermore, the sheet guides 331 determines a position of the paper P in the front-rear direction. The sheet support plate 332 is a flat plate member and functions to align trailing ends (right-hand side ends in FIG. 3) of sheets of paper P stacked on the processing tray 33.

The stapler 34 performs stapling processing on the sheaf Q of paper P on the processing tray 33. The stapler 34 includes a head 341. The head 341 is adapted to be elevated and lowered and performs the stapling processing on the sheaf Q of paper P when lowered and put into contact with a top surface of the sheaf Q of paper P.

The ejection roller 35 rotates in a reversible manner. The ejection roller 35 is swingable about a center of a driven roller 351. When the ejection roller 35 is swung clockwise as indicated by arrow Y1 in FIG. 2, the ejection roller 35 shifts from a state illustrated in FIG. 2 to a state illustrated in FIG. 3. FIG. 2 illustrates a state of the ejection roller 35 in contact with the ejection roll 36. Hereinafter, the state of the ejection roller 35 in contact with the ejection roll 36 as illustrated in FIG. 2 is referred to simply as "a contact state". FIG. 3 illustrates a state of the ejection roller 35 separated from the ejection roll 36. Hereinafter, the state of the ejection roller 35 separated from the ejection roll 36 as illustrated in FIG. 3 is referred to simply as "a separated state". When the ejection roller 35 is swung counterclockwise as indicated by arrow Y2 in FIG. 3, the ejection roller 35 shifts from the separated state to the contact state. The ejection roll 36 and the ejection roller 35 sandwich and convey paper P (or a sheaf Q of paper P). The ejection roller 35 and the ejection roll 36 are equivalent to the "ejecting section".

Sheaves Q of paper P ejected by the ejection roller 35 are stacked on the exit tray 37. The exit tray 37 is adapted to be elevated and lowered such that the greater the height of the sheaves Q of paper P stacked on the exit tray 37 is, the more the exit tray 37 is lowered.

The height detector 4 detects the height of the sheaves Q of paper P stacked on the exit tray 37. The height detector 4 includes a contacting member 411. The contacting member 411 is stood in a top-bottom direction (vertical direction). A position of the contacting member 411 in this state is referred to as a retraction position. Configuration of the height detector 4 will be described later with reference to FIGS. 7, 8A and 8B. The height detector 4 is equivalent to the "detector".

The controller 5 includes a central processing unit (CPU), read only memory (ROM), and random access memory (RAM). A control program is stored in the ROM. The CPU controls operation of the post-processing unit 3 through reading and executing the control program stored in the ROM. The RAM is used as a work area during execution of the control program by the CPU. The CPU functions as a shifting controller 51 and an elevation controller 52 through reading and executing the control program stored in the ROM.

The shifting controller 51 shifts the sheaf Q of paper P using the sheet guides 331 so that a stapled location in the sheaf Q of paper P in the front-rear direction matches a position of a distal end of the contacting member 411 in the front-rear direction. The shifting controller 51 will be described later with reference to FIG. 6.

The elevation controller 52 elevates and lowers the exit tray 37 according to the height of the sheaves Q of paper P stacked on the exit tray 37. The height of the sheaves Q of paper P stacked on the exit tray 37 is detected by the height detector 4. The elevation controller 52 will be described later with reference to FIG. 10.

Figure 4:
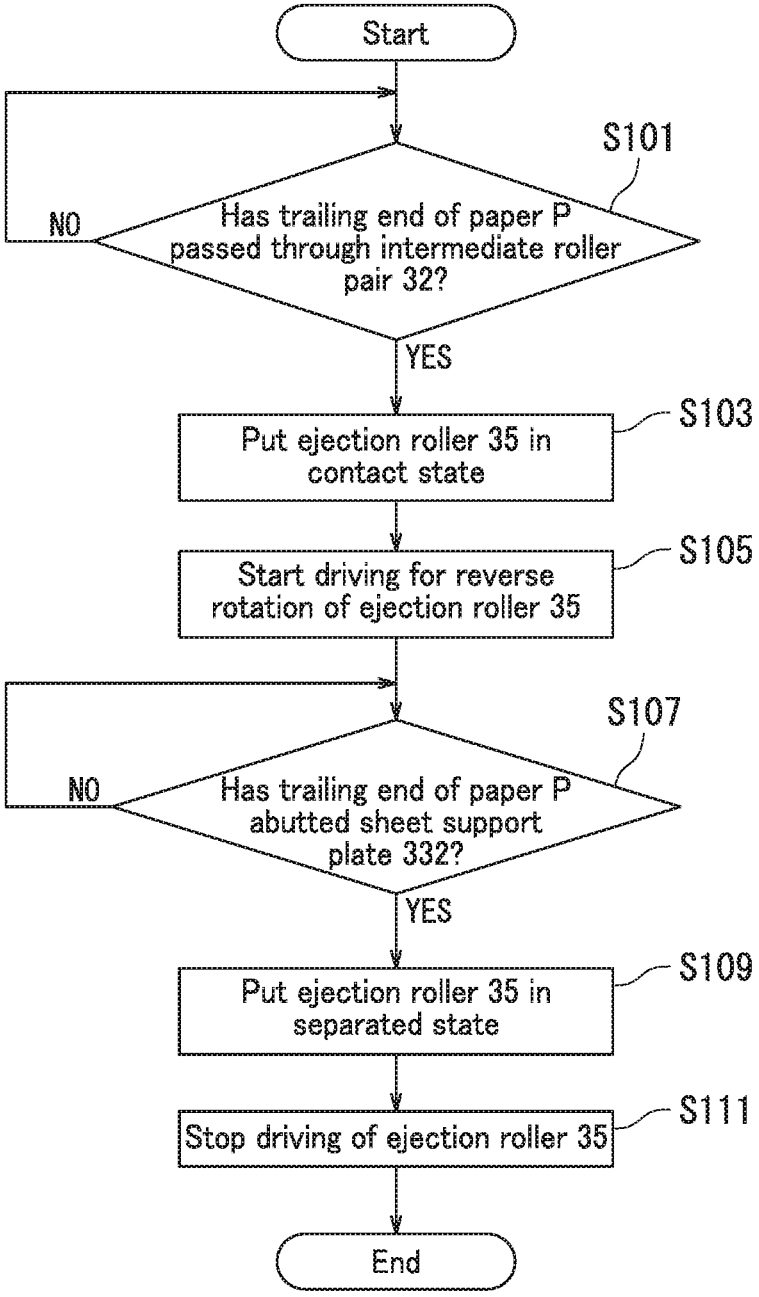
FIG. 4 is a flowchart illustrating an operation of the post-processing unit illustrated in FIG. 2 for stacking paper sheets.
Figure 5:
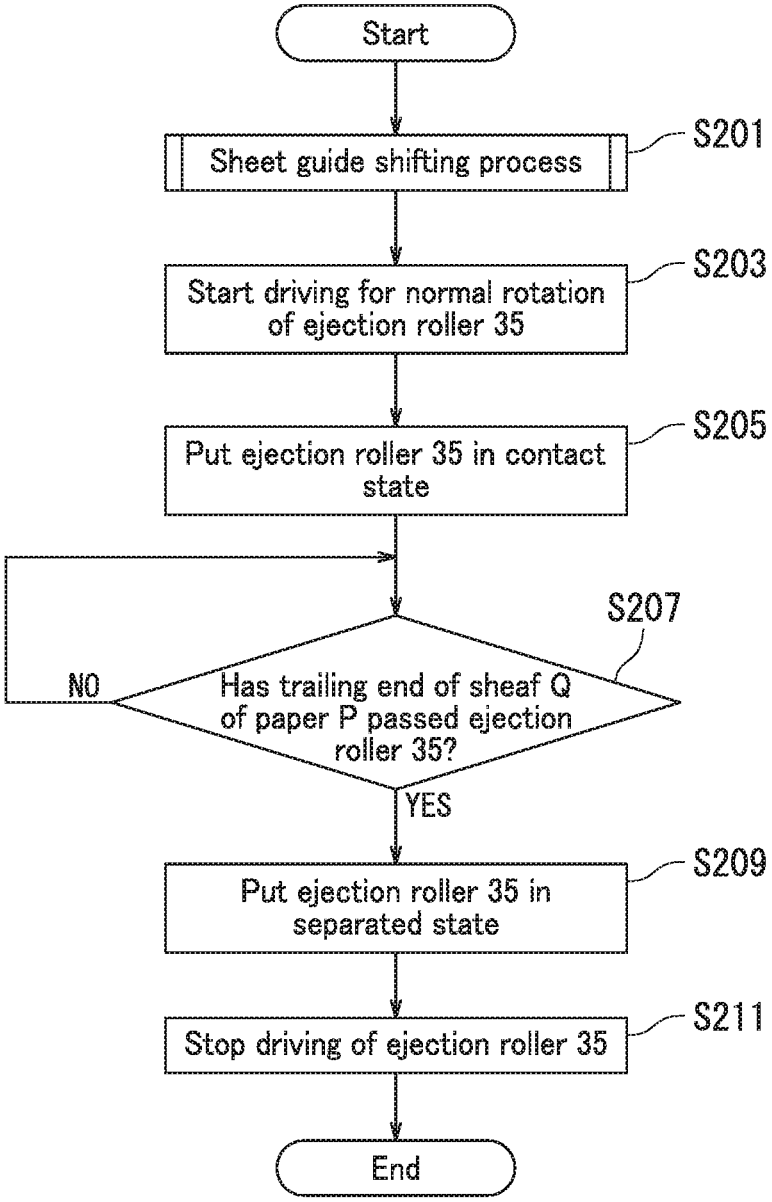
FIG. 5 is a flowchart illustrating an operation of the post-processing unit illustrated in FIG. 2 for ejecting a stapled sheet sheaf.
Figure 6:
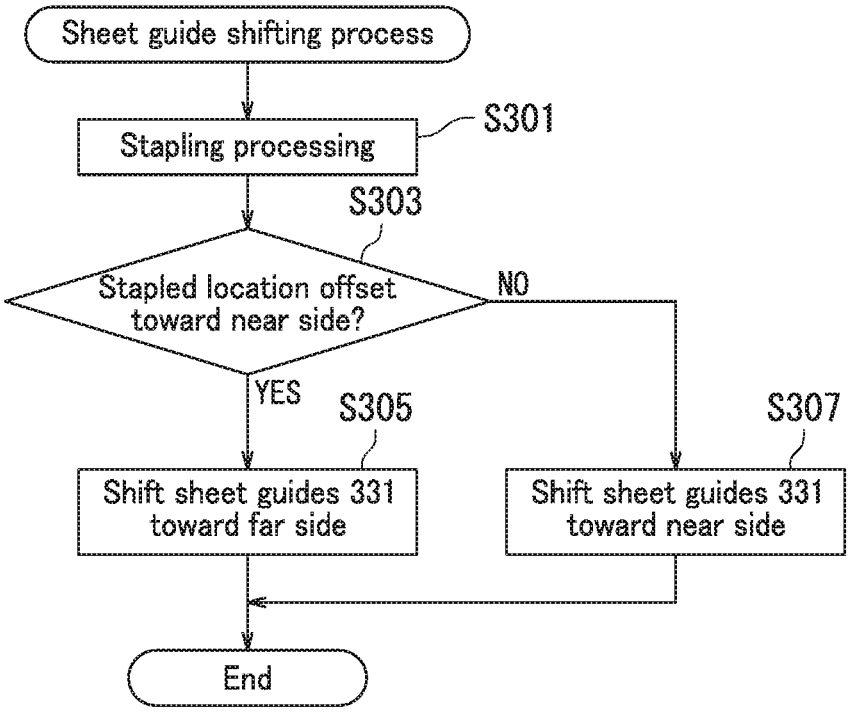
FIG. 6 is a flowchart illustrating an operation of the post-processing unit illustrated in FIG. 2 for a sheet guide shifting process.

The following describes operation of the post-processing unit 3 with reference to FIGS. 4 to 6. In the following description, a trailing end of paper P refers to a right-hand end of the paper P in FIGS. 2 and 3 regardless of a traveling direction of the paper P. A leading end of paper P refers to a left-hand end of the paper P in FIGS. 2 and 3.

First, as an operation of the post-processing unit 3, an operation for stacking, on the processing tray 33, sheets of paper P conveyed from the intermediate roller pair 32 will be described with reference to FIG. 4. FIG. 4 is a flowchart illustrating the operation of the post-processing unit 3 for stacking sheets of paper P. The ejection roller 35 is initially in a non-driven state (more specifically, an idle state) and in the separated state. The entirety of the following operation is implemented by the controller 5.

First, it is determined whether or not a trailing end of the paper P has passed through the intermediate roller pair 32 (Step S101). When the controller 5 determines that the trailing end of the paper P has not passed through the intermediate roller pair 32 (No in Step S101), the process is put in a standby state. The standby state refers to a state in which the process is on hold until a certain condition is determined to be satisfied. In Step S101, the operation is put on hold until it is determined that the trailing end of the paper P has passed through the intermediate roller pair 32. When the controller 5 determines that the trailing end of the paper P has passed through the intermediate roller pair 32 (Yes in Step S101), the operation proceeds to Step S103. The ejection roller 35 then shifts from the separated state to the contact state (Step S103). Consequently, the paper P stops while being sandwiched between the ejection roller 35 and the ejection roll 36. Next, driving for reversed (counter-clockwise) rotation of the ejection roller 35 is started (Step S105). Thus, the paper P is conveyed toward the sheet support plate 332 of the processing tray 33.

Next, it is determined whether or not the trailing end of the paper P has abutted the sheet support plate 332 (Step S107). When it is determined that the trailing end of the paper P has not abutted the sheet support plate 332 (No in Step S107), the process is put in the standby state. When it is determined that the trailing end of the paper P has abutted the sheet support plate 332 (Yes in Step S107), the process proceeds to Step S109. The ejection roller 35 then shifts from the contact state to the separated state (Step S109). Next, driving for rotation of the ejection roller 35 is stopped (Step S111), and the process comes to an end.

The operation for stacking the paper P conveyed from the intermediate roller pair 32 on the processing tray 33 is repeated a specified number of times corresponding to the number of sheets of the paper P that form a sheaf Q. In a situation in which the sheaf Q is to include ten sheets of the paper P, for example, the operation for stacking the paper P conveyed from the intermediate roller pair 32 on the processing tray 33 is repeated ten times. As a result, the sheets of the paper P that form the sheaf Q are stacked on the processing tray 33.

The following describes an operation of the post-processing unit 3 for ejecting, to the exit tray 37, the sheaf Q of paper P on which the stapling processing has been performed on the processing tray 33 with reference to FIG. 5. FIG. 5 is a flowchart illustrating the operation of the post-processing unit 3 for ejecting the stapled sheaf Q of paper P. Note that the ejection roller 35 is initially in the non-driven state (more specifically, the idle state) and in the separated state.

First, the sheet guides 331 perform a process for shifting the sheaf Q of paper P in the front-rear direction (a direction perpendicular to the plane of FIG. 2) (Step S201). As a result, a stapled location in the sheaf Q of paper P in the front-rear direction matches a position of the distal end of the contacting member 411 in the front-rear direction. In the following description, the process for shifting the sheaf Q of paper P in the front-rear direction using the sheet guides 331 will be referred to as "a sheet guide shifting process".

Subsequently, driving for normal (clockwise) rotation of the ejection roller 35 is started (Step S203). Next, the ejection roller 35 is changed from the separated state to the contact state (Step S205). As a result, the sheaf Q of paper P is ejected to the exit tray 37 while being sandwiched between the ejection roller 35 and the ejection roll 36.

Next, it is determined whether or not the trailing end of the sheaf Q of paper P has passed the ejection roller 35 (Step S207). When it is determined that the trailing end of the sheaf Q of paper P has not passed the ejection roller 35 (No in Step S207), the process is put in the standby state. When it is determined that the trailing end of the sheaf Q of paper P has passed the ejection roller 35 (Yes in Step S207), the process proceeds to Step S209. The ejection roller 35 is then changed from the contact state to the separated state (Step S209). Subsequently, driving for rotation of the ejection roller 35 is stopped (Step S211), and the process comes to an end.

Through the operation for ejecting the sheaf Q of paper P on which the stapling processing has been performed on the processing tray 33, the sheaf Q of paper P on which the stapling processing has been performed on the processing tray 33 is ejected to the exit tray 37.

The following describes the sheet guide shifting process shown in Step S201 in FIG. 5 with reference to FIG. 6. FIG. 6 is a flowchart illustrating an operation of the post-processing unit 3 for the sheet guide shifting process. The entirety of the following process is implemented by the shifting controller 51. For convenience, the following describes an example in which the stapling processing is performed on a location at a rear-side end of paper P and each sheaf Q of paper P is shifted so that the stapled location matches the position of the distal end of the contacting member 411. First, the stapling processing is performed on each sheaf Q of paper P on the processing tray 33 (Step S301). A location on which the stapling processing is to be performed is for example instructed through an operation section of the image forming apparatus 100 or an external device (for example, a personal computer). The stapling processing is performed on a location preset according to the size of the paper P. Next, it is determined whether the location on which the stapling processing has been performed on the processing tray 33 is offset toward the front side or toward the rear side from the contacting member 411 (Step S303). When it is determined that the stapled location is not offset toward the front side from the contacting member 411 (No in Step S303), the process proceeds to Step S307.

When it is determined that the stapled location is offset toward the front side from the contacting member 411 (Yes in Step S303), the process proceeds to Step S305. Subsequently, the sheet guides 331 shift the sheaf Q of paper P toward the rear side by a predetermined distance (Step S305), and the process comes to an end. As a result of Step S305, the stapled location matches the position of the distal end of the contacting member 411.

When the result of the determination in Step S303 is negative (No) (when it is determined that the stapled location in the sheaf Q of paper P is offset toward the rear side from the contacting member 411), the sheet guides shift the sheaf Q of paper P toward the front side by a predetermined distance (Step S307), and the process comes to an end. As a result of Step S307, the stapled location matches the position of the distal end of the contacting member 411.

As described with reference to FIG. 6, the shifting controller 51 shifts each sheaf Q of paper P to be ejected in a situation in which the stapler 34 staples one location in the sheaf Q of paper P. Thus, a stapled location S in each of the sheaves Q of paper P stacked on the exit tray 37 matches a detection point of the height detector 4. Accordingly, the height detector 4 can accurately detect the height of the stapled locations in the sheaves Q of paper P stacked on the exit tray 37.

The present embodiment is described for a configuration in which the stapled location is positioned to match the position of the distal end of the contacting member 411. However, the present embodiment is not limited to this configuration. The stapled location may be positioned to match a position of a distal end of any of contacting members 412 to 414. The stapled location is positioned to match one of the contacting members 411 to 414 that is selected in accordance with the size of the paper P and the stapled location.

Since each sheaf Q of paper P on the processing tray 33 is movable in the front-rear direction (the direction perpendicular to the plane of FIG. 2 and FIG. 3), the stapled location in the sheaf Q of paper P on the exit tray 37 can be readily positioned to match the detection point of the height detector 4.

Furthermore, the sheet guides 331 shift each sheaf Q of paper P in the front-rear direction (the direction perpendicular to the plane of FIG. 2 and FIG. 3). Thus, the stapled location in each of the sheaves Q of paper P stacked on the exit tray 37 can be readily positioned to match the detection point of the height detector 4.

Figure 7:
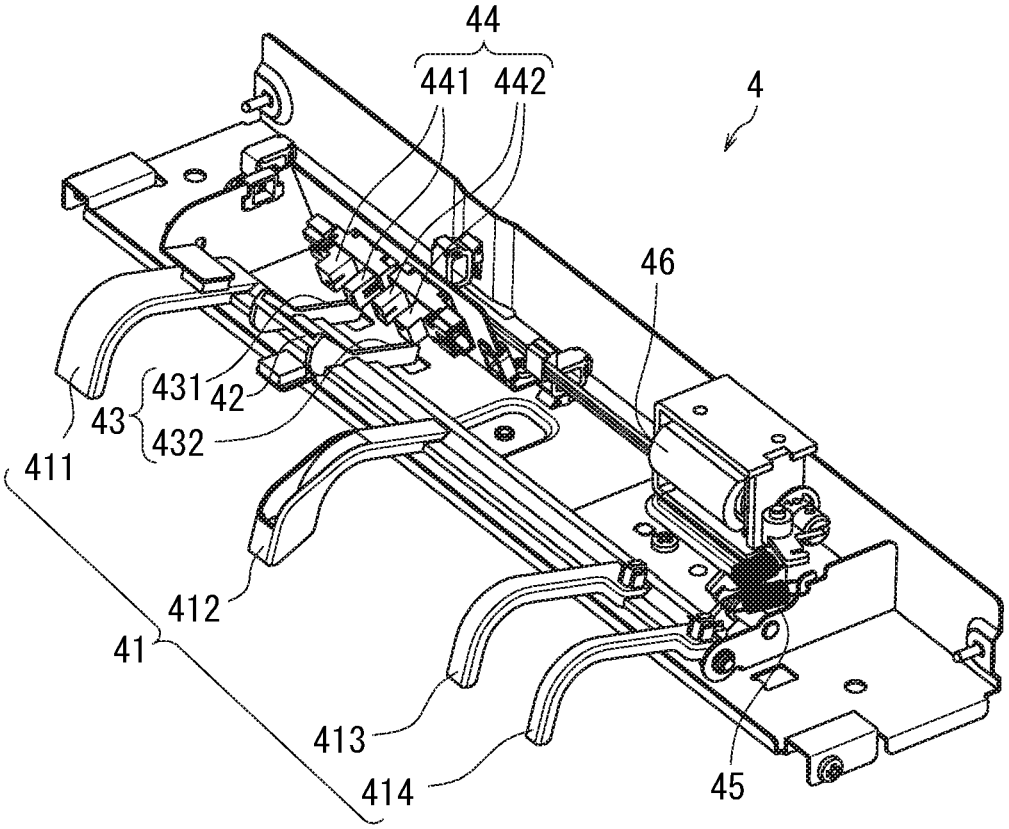
FIG. 7 is a perspective view illustrating configuration of a height detector illustrated in FIG. 2.
Figure 8A:
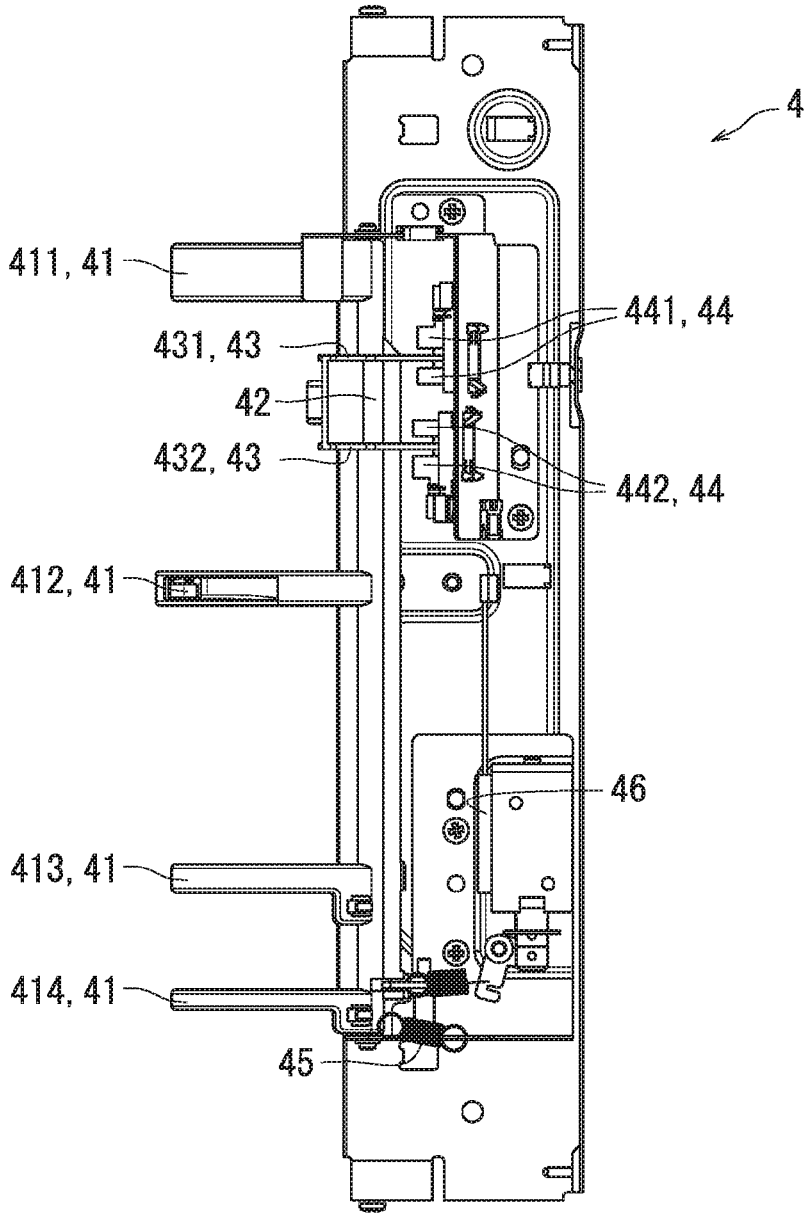
FIG. 8A is a plan view of the height detector illustrated in FIG. 2.
Figure 8B:
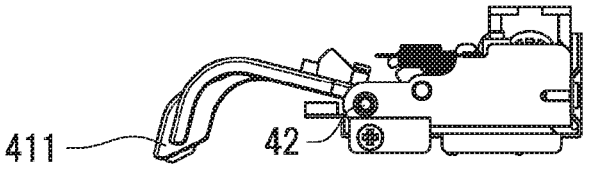
FIG. 8B is a side view of the height detector illustrated in FIG. 2.

The following describes configuration of the height detector 4 with reference to FIGS. 7, 8A, and 8B. FIG. 7 is a perspective view illustrating configuration of the height detector 4. FIG. 8A is a plan view of the height detector 4. FIG. 8B is a side view of the height detector 4. The height detector 4 includes a contacting member 41, a coupling member 42, a light shielding plate 43, a sensor 44, a spring 45, and a solenoid 46.

The contacting member 41 is a rod-shaped member having a distal end that comes in contact with a top surface of a topmost sheaf Q of sheaves Q of paper P stacked on the exit tray 37. The contacting member 41 is pivotable at a proximal end thereof. The proximal end of the contacting member 41 is fixed to the coupling member 42. The contacting member 41 includes the four contacting members 411, 412, 413, and 414. The four contacting member 411, 412, 413, and 414 are arranged in the front-rear direction along the coupling member 42.

The contacting member 41 is pressed in a clockwise direction by the spring 45. The contacting member 41 is pressed in a counterclockwise direction by the solenoid 46. When the height detector 4 is to detect the height of the sheaves Q of paper P stacked on the exit tray 37, the contacting member 41 is pressed by the solenoid 46. As a result, the distal end of the contacting member 41 comes in contact with the top surface of the topmost sheaf Q of the sheaves Q of paper P stacked on the exit tray 37. When the height detector 4 is not to detect the height of the sheaves Q of paper P stacked on the exit tray 37, the contacting member 41 is pivoted in the clockwise direction by the spring 45. As a result, the contacting member 41 is shifted into the retraction position illustrated in FIGS. 2 and 3.

The coupling member 42 is a rod-shaped member elongated in the front-rear direction. The proximal ends of the four contacting members 411, 412, 413, and 414 are fixed to the coupling member 42. The coupling member 42 is turnable about its central axis. Since the contacting member 41 is integral with the coupling member 42, the contacting member 41 is also turnable about the central axis of the coupling member 42.

The light shielding plate 43 is a plate-shaped member having a proximal end fixed to the coupling member 42 and a distal end disposed at a position that allows the light shielding plate 43 to be a light shield for the sensor 44. The light shielding plate 43 includes two light shielding plates 431 and 432. The two light shielding plates 431 and 432 are disposed so as to be light shields for sensors 441 and 442, respectively. The light shielding plates 431 and 432 have the same shape and are arranged in the front-rear direction of the image forming apparatus 100 (post-processing unit 3) along the coupling member 42. The top-bottom direction of the image forming apparatus 100 is a direction perpendicular to the plane of FIG. 8A. A left-right direction of the image forming apparatus 100 is a left-right direction on the plane of FIG. 8A.

The sensor 44 is a transmissive photosensor that detects a position of the light shielding plate 43. The sensor 44 includes the two sensors 441 and 442. The sensors 441 and 442 detect positions of the light shielding plates 431 and 432, respectively. The sensor 442 is located at a higher height than the sensor 441. The sensor 44 is equivalent to the "angle detector". The sensors 441 and 442 are equivalent to the "photodetector".

As a result of a sheaf Q of paper P being ejected to the exit tray 37, the position of the top surface of the topmost sheaf Q of the sheaves of paper P stacked on the exit tray 37 becomes higher. In response to the top surface of the topmost sheaf Q of paper P becoming higher, the contacting member 41 is caused to turn about the central axis of the coupling member 42 in a clockwise direction in FIG. 8B. The light shielding plate 43 turns about the central axis of the coupling member 42 in the clockwise direction in company with the contacting member 41 turning about the central axis of the coupling member 42 in the clockwise direction in FIG. 8B. As a result, the distal end of the light shielding plate 43 passes through the sensor 44 from top to bottom.

As described with reference to FIGS. 7, 8A, and 8B, the contacting member 41 includes the four contacting members 411, 412, 413, and 414, and the four contacting members 411, 412, 413, and 414 are arranged in the front-rear direction along the coupling member 42. The height of the sheaves Q of paper P stacked on the exit tray 37 can therefore be detected accurately. In a situation in which the stapling processing has been performed on two locations in a central region of the sheaf Q of paper P in the front-rear direction, for example, the sheaves Q of paper P has a greatest height at the central region thereof in the front-rear direction. In such a situation, the contacting members 412 and 413 are used to detect the height of the sheaf Q of paper P. Preferably, one or more of the contacting members to be used for detection of the height of the sheaf Q of paper P are selected based on the size of paper P in the front-rear direction, the number of stapled locations, and the region including the stapled locations. In such a situation, the height of the sheaves Q of paper P can be detected more accurately.

Figure 9A:
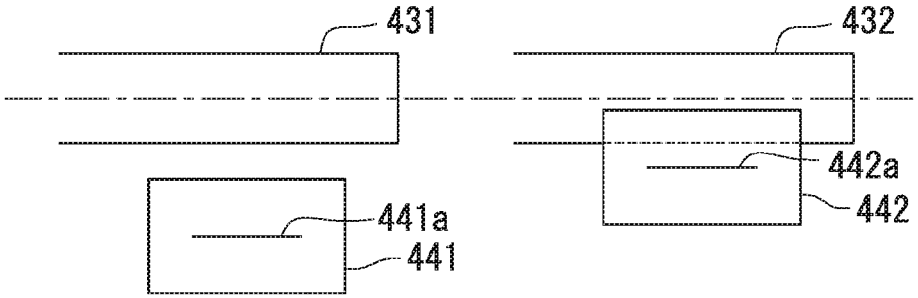
FIGS. 9A-9E illustrate transitions of detection signals of the height detector illustrated in FIG. 7.
Figure 9B:
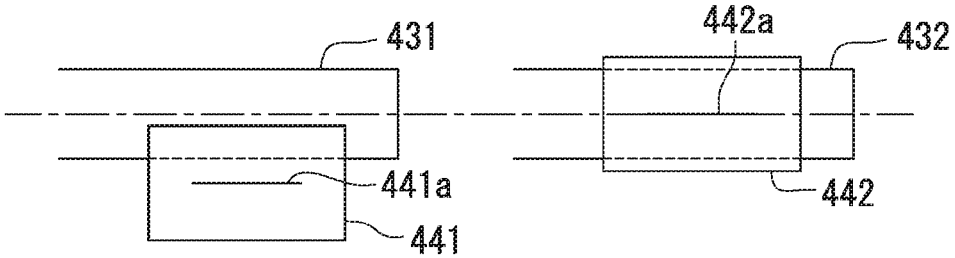
Figure 9C:
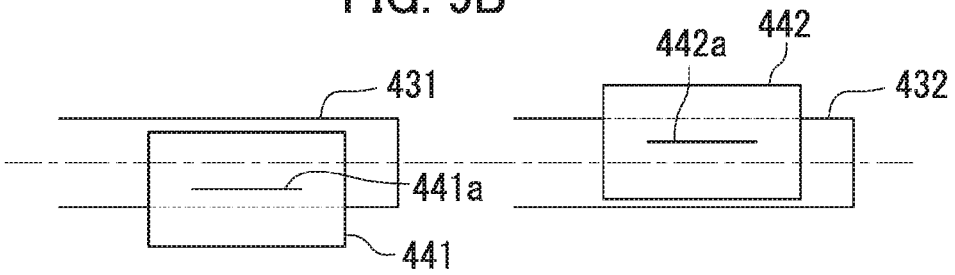
Figure 9D:
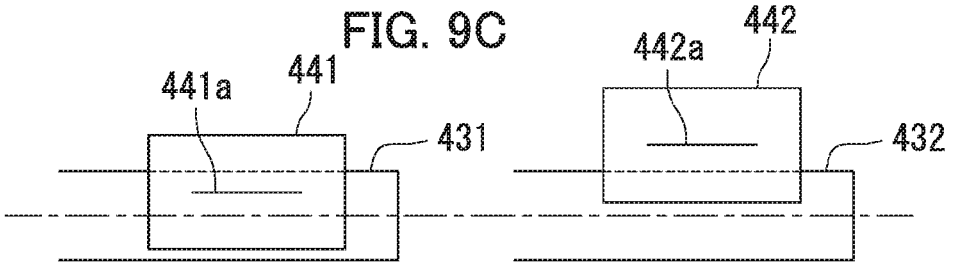
Figure 9E:
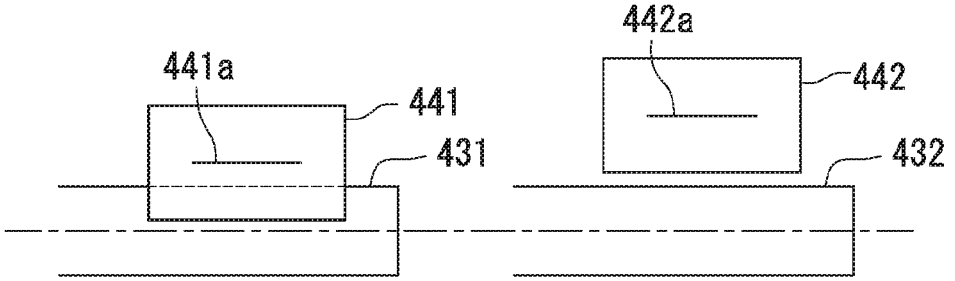

The following describes changes in detection signals of the sensor 44 that occur as the distal end of the light shielding plate 43 passes through the sensor 44 from top to bottom with reference to FIGS. 9A-9E. FIGS. 9A-9E illustrate transitions of detection signals of the height detector 4. An upper side of FIGS. 9A-9E is an upper side of the image forming apparatus 100, and a lower side of FIGS. 9A-9E is a lower side of the image forming apparatus 100. FIG. 9A illustrates a state in which the light shielding plates 431 and 432 are located at a higher height than the two sensors 441 and 442. FIG. 9B illustrates a state in which the light shielding plates 431 and 432 are located at the same height as the upper sensor 442. FIG. 9C illustrates a state in which the light shielding plates 431 and 432 are located at a height higher than the lower sensor 441 and lower than the upper sensor 442. FIG. 9D illustrates a state in which the light shielding plates 431 and 432 are located at the same height as the lower sensor 441. FIG. 9E illustrates a state in which the light shielding plates 431 and 432 are located at a height lower than the two sensors 441 and 442.

The sensor 441 has slits 441*a* in a central region thereof in the top-bottom direction. The sensor 442 has slits 442*a* in a central region thereof in the top-bottom direction. The slits 441*a* are formed at a light transmission position and a light reception position. Likewise, the slits 442*a* are formed at a light transmission position and a light reception position. The sensor 441 is on while the slits 441*a* are shielded by the light shielding plate 431. The sensor 441 is off while the slits 441*a* are not shielded by the light shielding plate 431. The sensor 442 is on while the slits 442*a* are shielded by the light shielding plate 432. The sensor 442 is off while the slits 442*a* are not shielded by the light shielding plate 432.

During the state illustrated in FIG. 9A, the sensors 441 and 442 are off since the slits 441*a* are not shielded by the light shielding plate 431 and the slits 442*a* are not shielded by the light shielding plate 432. During the state illustrated in FIG. 9B, the sensor 441 is off since the slits 441*a* are not shielded by the light shielding plate 431. On the other hand, the sensor 442 is on since the slits 442*a* are shielded by the light shielding plate 432. During the state illustrated in FIG. 9C, the sensors 441 and 442 are on since the slits 441*a* are shielded by the light shielding plate 431 and the slits 442*a* are shielded by the light shielding plate 432.

During the state illustrated in FIG. 9D, the sensor 441 is on since the slits 441*a* are shielded by the light shielding plate 431. On the other hand, the sensor 442 is off since the slits 442*a* are not shielded by the light shielding plate 432. During the state illustrated in FIG. 9E, the sensors 441 and 442 are off since the slits 441*a* are not shielded by the light shielding plate 431 and the slits 442*a* are not shielded by the light shielding plate 432.

As the distal end of the light shielding plate 431 passes through the sensor 441 from top to bottom and the distal end of the light shielding plate 432 passes through the sensor 442 from top to bottom, detection signals of the sensors 441 and 442 change as described with reference to FIG. 9A-9E. Thus, the sensor 44 detects whether or not an inclination angle of the contacting member 41 is within a predetermined range. The predetermined range is for example a range that allows both the sensors 441 and 442 to be on.

The elevation controller 52 elevates and lowers the exit tray 37 as described below with reference to FIG. 10 according to the changes in detection signals of the sensors 441 and 442 described with reference to FIGS. 9A-9E.

The elevation controller 52 controls elevation of the exit tray 37 according to a result of detection by the height detector 4. Specifically, the elevation controller 52 controls elevation of the exit tray 37 according to the detection signals of the sensors 441 and 442. More specifically, the elevation controller 52 for example controls elevation of the exit tray 37 so that the detection signals of the sensors 441 and 442 are on. The elevation controller 52 controls elevation of the exit tray 37 every time the ejection roller 35 ejects a sheaf Q of paper P to the exit tray 37.

Furthermore, the height detector 4 includes the sensor 44 as described with reference to FIGS. 7 to 9E. The sensor 44 detects whether or not the inclination angle of the contacting member 41 is within the predetermined range. The height detector 4 can therefore detect whether or not the inclination angle of the contacting member 41 is within the predetermined range. The elevation controller 52 controls elevation of the exit tray 37 according to the detection signals of the height detector 4. Thus, the elevation controller 52 can control elevation of the exit tray 37 appropriately.

The upper sensor 442 is higher than the sensor 441. It is therefore possible to determine that the inclination angle of the contacting member 41 is within the predetermined range when the sensor 441 is sensing the light shielding plate 431 and the sensor 442 is sensing the light shielding plate 432. Thus, it is possible to detect whether or not the inclination angle of the contacting member 41 is within the predetermined range with a simple configuration.

Figure 10:
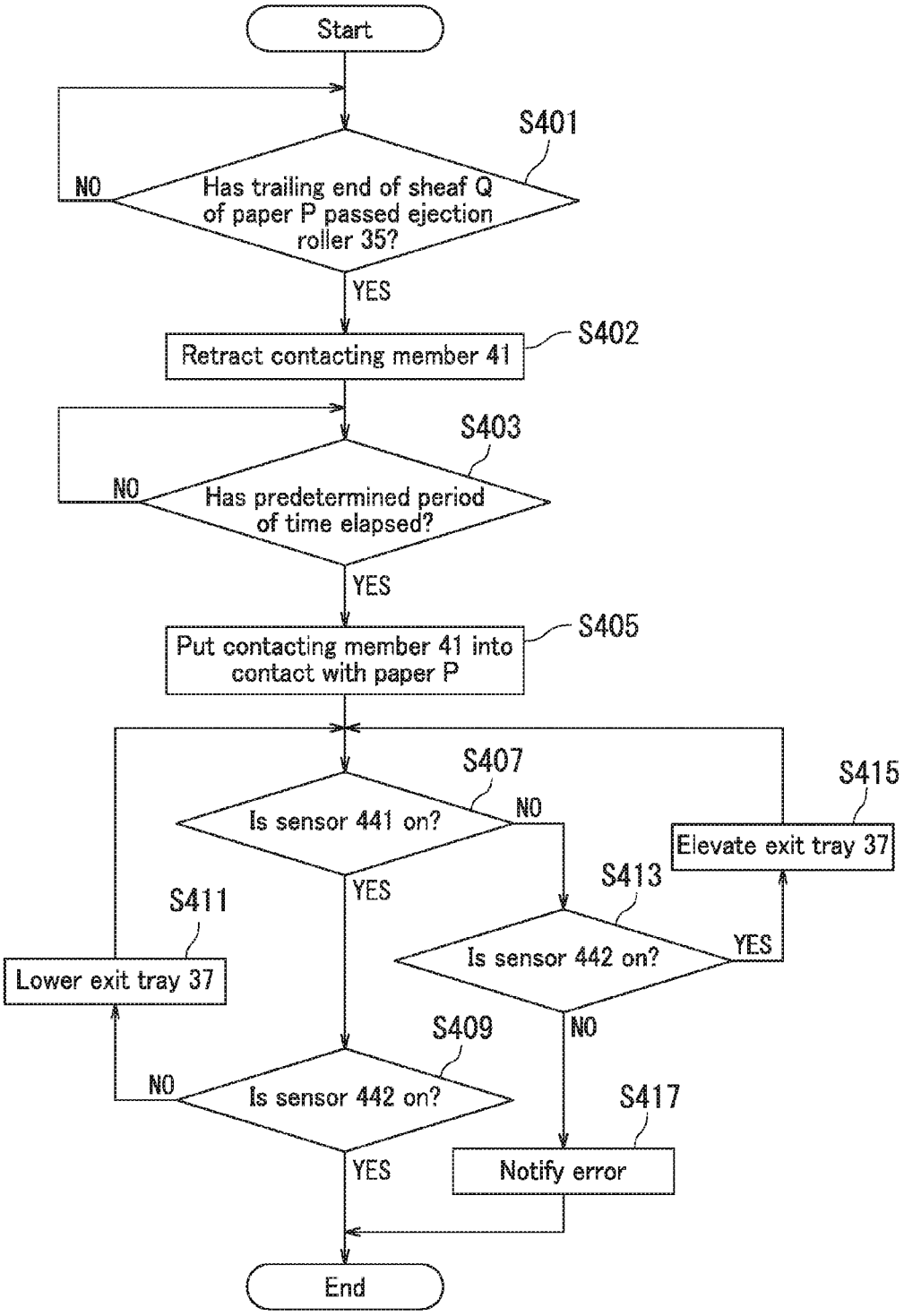
FIG. 10 is a flowchart illustrating an operation for elevating and lowering an exit tray according to the detection signals of the height detector illustrated in FIG. 7.

The following describes an operation for elevating and lowering the exit tray 37 with reference to FIG. 10. FIG. 10 is a flowchart illustrating the operation for elevating and lowering the exit tray 37 according to the detection signals of the height detector 4. The entirety of the following operation is implemented by the elevation controller 52. First, it is determined whether or not the trailing end of a sheaf Q of paper P has passed the ejection roller 35 (Step S401). When it is determined that the trailing end of the sheaf Q of paper P has not passed the ejection roller 35 (No in Step S401), the process is put in the standby state. When it is determined that the trailing end of the sheaf Q of paper P has passed the ejection roller 35 (Yes in Step S401), the process proceeds to Step S402. Then, the contacting member 41 is retracted (Step S402). Next, it is determined whether or not a predetermined period of time (for example, one second) has elapsed (Step S403).

When it is determined that the predetermined period of time has not elapsed (No in Step S403), the process is put in the standby state. When it is determined that the predetermined period of time has elapsed (Yes in Step 403), the process proceeds to Step S405. Then, the contacting member 41 is put into contact with the topmost paper P of the sheaf Q of paper P on the exit tray 37 (Step S405). Next, it is determined whether or not the sensor 441 is on (Step S407). When it is determined that the sensor 441 is not on (No in Step S407), the process proceeds to Step S413. When it is determined that the sensor 441 is on (Yes in Step S407), the process proceeds to Step S409. Subsequently, it is determined whether or not the sensor 442 is on (Step S409). When it is determined that the sensor 442 is on (Yes in Step S409), the process comes to an end.

When it is determined that the sensor 442 is not on (No in Step S409), the process proceeds to Step S411. Then the exit tray 37 is lowered by a predetermined distance (for example, 1 mm) (Step S411), and the process returns to Step S407.

If a result of the determination in Step S407 is negative (No), it is determined whether or not the sensor 442 is on (Step S413). When it is determined that the sensor 442 is not on (No in Step S413), an error is externally notified (Step S417), and the process comes to an end. When it is determined that the sensor 442 is on (Yes in Step S413), the process proceeds to Step S415. Then the exit tray 37 is elevated by a predetermined distance (for example, 1 mm) (Step S415), and the process returns to Step S407.

As described with reference to FIG. 10, elevation of the exit tray 37 can be appropriately controlled according to the result of detection by the height detector 4. Furthermore, as described with reference to FIG. 6, each sheaf Q of paper P to be ejected can be shifted so that the stapled location in each of the sheaves Q of paper P stacked on the exit tray 37 matches the detection point of the height detector 4. Thus, elevation of the exit tray 37 can be controlled appropriately according to the height of the sheaves Q of paper P at the stapled locations.

Since the exit tray 37 is elevated and lowered according to the height of the sheaves Q of paper P detected by the height detector 4, the exit tray 37 can be elevated and lowered appropriately.

As described with reference to FIG. 10, an error is externally notified in Step S417. More specifically, when the sensors 441 and 442 are off, an error is externally notified. The sensors 441 and 442 are off while the light shielding plate 431 is higher than the sensor 441 and the light shielding plate 432 is higher than the sensor 442 (the state illustrated in FIG. 9A). Likewise, the sensors 441 and 442 are off while the light shielding plate 431 is lower than the sensor 441 and the light shielding plate 432 is lower than the sensor 442 (the state illustrated in FIG. 9E). That is, positions of the light shielding plates 431 and 432 cannot be determined while the sensors 441 and 442 are off. In such a case, an error is externally notified.

Figure 11A:
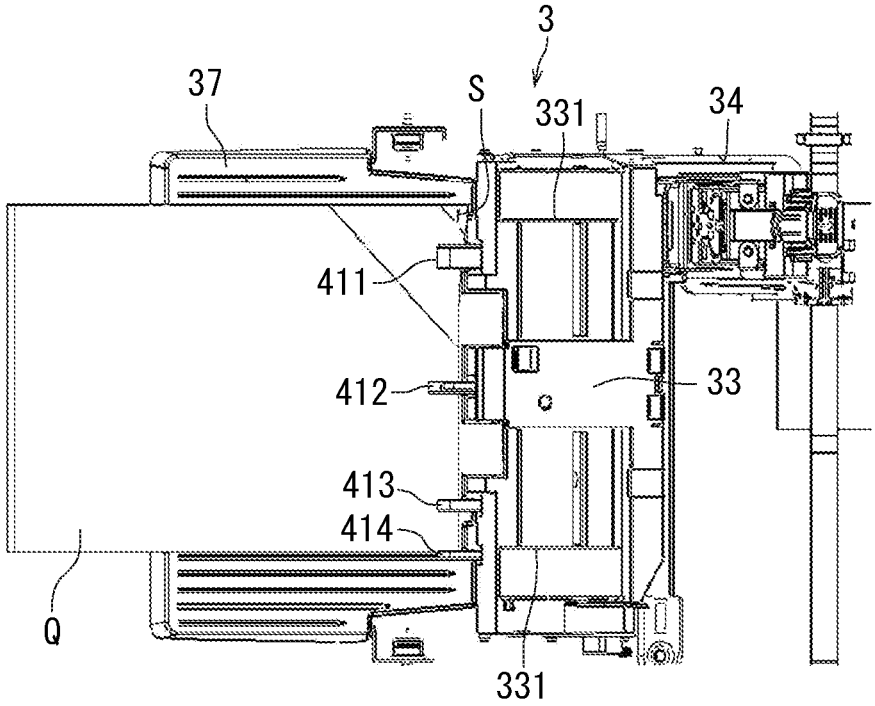
FIGS. 11A and 11B illustrate a position of sheet sheaves in a configuration in which positioning of each sheet sheaf in a front-rear direction is not performed.
Figure 11B:
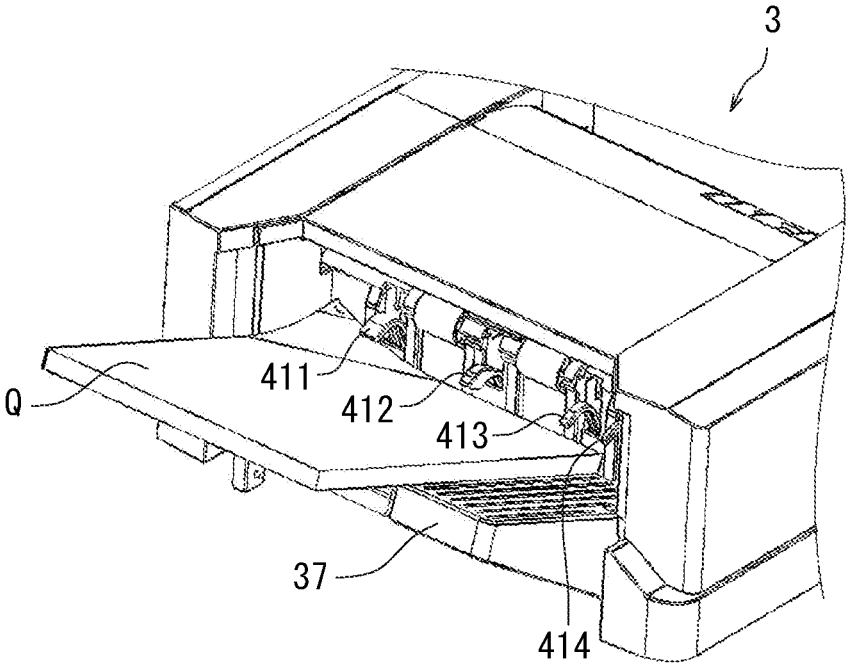
Figure 12A:
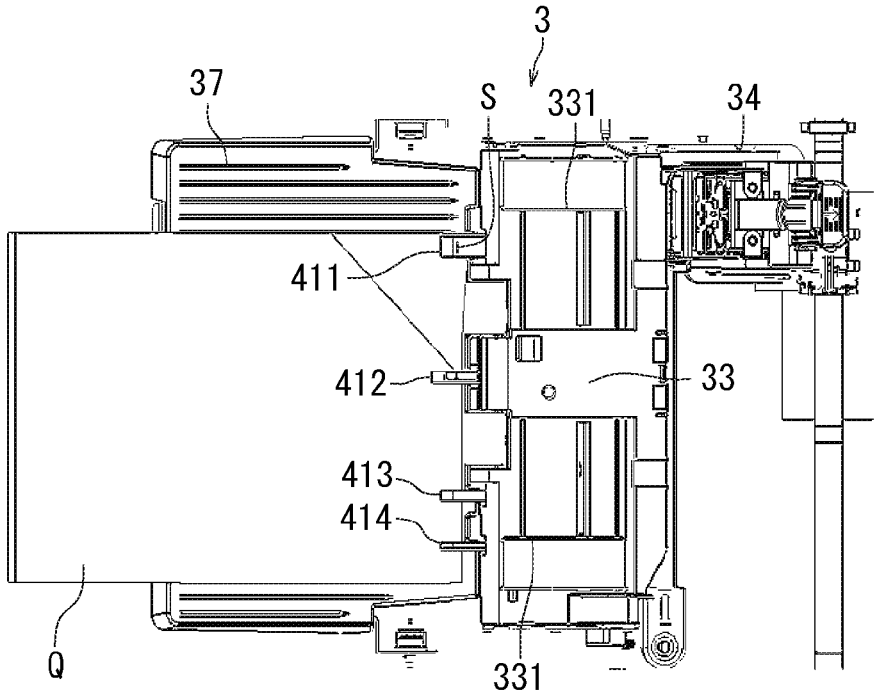
FIGS. 12A and 12B illustrate a position of sheet sheaves in a configuration in which positioning of each sheet sheaf in the front-rear direction is performed.
Figure 12B:
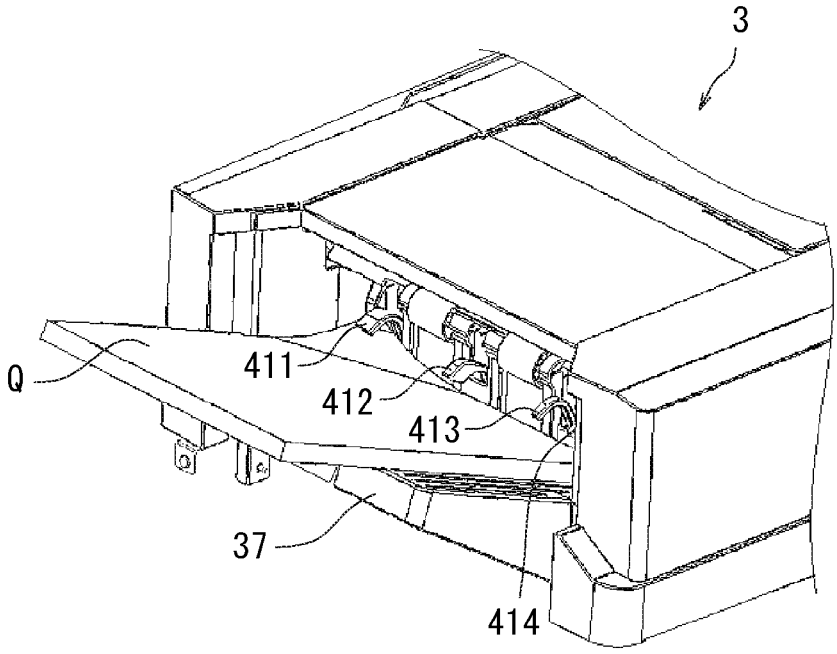

The following describes effects of the present disclosure with reference to FIGS. 11A, 11B, 12A, and 12B. FIGS. 11A and 11B illustrate a position of sheaves Q of paper P in a configuration in which positioning of each sheaf Q of paper P in the front-rear direction is not performed. FIG. 11A is a plan view of the post-processing unit 3. FIG. 11B is a perspective view of the post-processing unit 3. FIGS. 12A and 12B illustrate a position of sheaves Q of paper P in a configuration in which positioning of each sheaf Q of paper P in the front-rear direction is performed. FIG. 12A is a plan view of the post-processing unit 3. FIG. 12B is a perspective view of the post-processing unit 3.

As illustrated in FIGS. 11A and 11B, the stapled location S does not match the position of the distal end of the contacting member 411 in the configuration in which positioning of each sheaf Q of paper P in the front-rear direction is not performed. Therefore, the height detector 4 cannot detect the height of the sheaves Q of paper P stacked on the exit tray 37 at the stapled location. As a result, the topmost sheaf Q of the sheaves Q of paper P stacked on the exit tray 37 may block a nip between the ejection roller 35 and the ejection roll 36. If a subsequent sheaf Q of paper P is ejected with the topmost sheaf Q of paper P blocking the nip, the topmost sheaf Q of paper P may be pushed by the subsequent sheaf Q of paper P and fall off the exit tray 37.

On the other hand, as illustrated in FIGS. 12A and 12B, the stapled location S matches the position of the distal end of the contacting member 411 in the configuration in which positioning of each sheaf Q of paper P in the front-rear direction is performed. Therefore, the height detector 4 can detect the height of the sheaves Q of paper P stacked on the exit tray 37 at the stapled location. As a result, the exit tray 37 can be elevated or lowered to an appropriate position.

Through the above, an embodiment of the present disclosure has been described with reference to the drawings. However, the present disclosure is not limited to the above embodiment and may be implemented in various different forms that do not deviate from the essence of the present disclosure (for example, as described below in sections (1)-(3)). The drawings schematically illustrate elements of configuration in order to facilitate understanding. Properties of elements of configuration illustrated in the drawings, such as thickness, length, and number thereof, may differ from actual properties thereof in order to facilitate preparation of the drawings. Furthermore, properties of elements of configuration described in the above embodiments, such as shapes and dimensions, are merely examples and are not intended as specific limitations. Various alterations may be made so long as there is no substantial deviation from the configuration of the present disclosure.

(1) Although the present embodiment has been described for a configuration in which the conveyance rollers of the processing tray 33 and the ejection roller 35 eject a stapled sheaf Q of paper P to the exit tray 37, the present disclosure is not limited to this configuration. In another configuration, for example, a push-out sheet guide disposed opposite to the exit tray 37 may push out the sheaf Q of paper P to the exit tray 37. In such a configuration, an operation for pushing out the sheaf Q of paper P to the exit tray 37 by the push-out sheet guide and the operation for positioning the stapled location S to match the position of the distal end of the contacting member 411 by the sheet guides 331 may be performed at the same time. This configuration can reduce the cycle time.

(2) Although the present embodiment has been described for a configuration in which the contacting member includes the four contacting members 411, 412, 413, and 414, the present disclosure is not limited to this configuration. In another configuration, the contacting member 41 may include five or more contacting members. In such a configuration, the position of the topmost sheaf Q of sheaves Q of paper P stacked on the exit tray 37 can be detected more accurately. In still another configuration, the contacting member 41 may include three or fewer contacting members. According to such a configuration, the structure of the height detector 4 can be simplified.

(3) Although the present embodiment has been described for a configuration in which the sheet guides 331 shift each stapled sheaf Q of paper P in the front-rear direction, the present disclosure is not limited to the configuration. For example, the conveyance rollers may shift each sheaf Q of paper P in the front-rear direction.

What is claimed is:

1. A sheet post-processing device comprising:

a processing tray configured to receive a sheet sheaf;

a stapler configured to staple the sheet sheaf on the processing tray;

an exit tray configured to receive the sheet sheaf stapled by the stapler and ejected from the processing tray;

a detector configured to detect a height of the sheet sheaf on the exit tray at a predetermined detection point;

a sheet guide disposed between the stapler and the exit tray and configured to shift the sheet sheaf on the processing tray in a front-rear direction to determine a position of the sheet sheaf in the front-rear direction, the front-rear direction being perpendicular to a vertical direction and to a direction of ejection of the sheet sheaf from the processing tray to the exit tray; and a shifting controller, wherein the detector includes a contacting member having a proximal end and a distal end, the contacting member is pivotable at the proximal end thereof, the detection point of the detector is a point of contact between the distal end of the contacting member and a top surface of the topmost sheet sheaf on the exit tray, the shifting controller:

determines, in a situation in which the stapler staples one location at a trailing end of the sheet sheaf in terms of the direction of ejection of the sheet sheaf on the processing tray, whether the stapled location is offset toward a front side or toward a rear side from a position of the distal end of the contacting member in the front-rear direction; and controls the sheet guide to shift the sheet sheaf in the front-rear direction based on a result of the determination, and the sheet guide shifts the sheet sheaf on the processing tray in the front-rear direction in accordance with the control by the shifting controller so that the stapled location in the sheet sheaf matches the position of the distal end of the contacting member in terms of the front-rear direction.

2. The sheet post-processing device according to claim 1, wherein the exit tray is configured to be elevated and lowered, and the sheet post-processing device comprises an elevation controller configured to elevate and lower the exit tray according to the height of the sheet sheaf detected by the detector.

3. The sheet post-processing device according to claim 2, wherein the contacting member is rod-shaped, and the detector further includes an angle detector disposed in the vicinity of the proximal end of the contacting member and configured to detect whether or not an inclination angle of the contacting member is within a predetermined range.

4. The sheet post-processing device according to claim 3, wherein the detector includes two light shielding plates configured to shift with a change in the inclination angle of the contacting member, the angle detector includes two photodetectors configured to detect presence or absence of the two light shielding plates, respectively, at detection points of the photodetectors, the two photodetectors are offset from one another in the vertical direction, and the elevation controller determines that the inclination angle of the contacting member is within the predetermined range when both the two photodetectors are detecting presence of the two light shielding plates at the detection points of the photodetectors.

5. The sheet post-processing device according to claim 4, wherein the detector includes a coupling member, the coupling member is a rod-shaped member elongated in the front-rear direction and, the coupling member is turnable about a central axis thereof, and the proximal end of the contacting member and proximal ends of the two light shielding plates are fixed to the coupling member.

6. The sheet post-processing device according to claim 3, wherein the detector includes a plurality of contacting members, and the contacting members are arranged in the front-rear direction.

7. The sheet post-processing device according to claim 6, wherein the shifting controller controls the sheet guide to shift the sheet sheaf in the front-rear direction so that the stapled location in the sheet sheaf matches, in terms of the front-rear direction, a position of the distal end of one of the contacting members that is selected in accordance with a size of the sheet sheaf in the front-rear direction and the stapled location.

8. The sheet post-processing device according to claim 6, wherein a contacting member for detecting the height of the sheet sheaf is selected from the contacting members in accordance with a size of the sheet sheaf in the front-rear direction, the number of stapled locations, and the stapled locations.

9. The sheet post-processing device according to claim 1, further comprising:

a sheet support plate disposed at an upstream end of the processing tray in terms of the direction of ejection and configured to align the trailing end of the sheet sheaf in terms of the direction of ejection; and a roller pair configured to convey a plurality of sheets to be included in the sheet sheaf toward the sheet support plate.

10. The sheet post-processing device according to claim 1, wherein when the shifting controller determines that the stapled location is offset toward the front side from the position of the distal end of the contacting member, the sheet guide shifts the sheet sheaf toward the rear side by a predetermined distance so that the stapled location in the sheet sheaf matches the position of the distal end of the contacting member in terms of the front-rear direction, and when the shifting controller determines that the stapled location is offset toward the rear side from the position of the distal end of the contacting member, the sheet guide shifts the sheet sheaf toward the front side by a predetermined distance so that the stapled location in the sheet sheaf matches the position of the distal end of the contacting member in terms of the front-rear direction.

11. The sheet post-processing device according to claim 1, further comprising an ejection roller, wherein while the ejection roller is separated from the sheet sheaf, the sheet guide shifts the sheet sheaf on the processing tray in the front-rear direction in accordance with the control by the shifting controller so that the stapled location in the sheet sheaf matches the position of the distal end of the contacting member in terms of the front-rear direction, and after the stapled location in the sheet sheaf matches the position of the distal end of the contacting member in terms of the front-rear direction, the ejection roller comes in contact with the sheet sheaf and ejects the sheet sheaf to the exit tray.

12. The sheet post-processing device according to claim 1, further comprising an ejection roller configured to eject the sheet sheaf to the exit tray after the sheet sheaf is shifted by the sheet guide, wherein the position of the distal end of the contacting member matches the stapled location in the sheet sheaf on the exit tray.

13. An image forming apparatus comprising:

the sheet post-processing device according to claim 1; and an image forming section located upstream of the stapler in a conveyance direction of the sheet sheaf and configured to form an image on sheets of the sheet sheaf.

14. A sheet post-processing device comprising:

a processing tray configured to receive a sheet sheaf;

a stapler configured to staple the sheet sheaf on the processing tray;

an exit tray configured to receive the sheet sheaf stapled by the stapler and ejected from the processing tray;

a detector including a contacting member and configured to detect a height of the sheet sheaf on the exit tray at a detection point, the contacting member being configured to come in contact with a top surface of the sheet sheaf on the exit tray, the detection point coinciding with a position of the contacting member;

a sheet guide disposed between the stapler and the exit tray and configured to shift the sheet sheaf on the processing tray in a front-rear direction to determine a position of the sheet sheaf in the front-rear direction, the front-rear direction being perpendicular to a vertical direction and to a direction of ejection of the sheet sheaf from the processing tray to the exit tray; and a shifting controller configured to:

determine, in a situation in which the stapler staples one location at a trailing end of the sheet sheaf in terms of the direction of ejection of the sheet sheaf on the processing tray, whether the stapled location is offset toward a front side or toward a rear side from the position of the contacting member in the front-rear direction; and shift, based on a result of the determination, the sheet sheaf in the front-rear direction using the sheet guide so that the stapled location in the sheet sheaf matches the position of the contacting member in terms of the front-rear direction.

* * * * *